US006467634B1

(12) United States Patent
Pinco

(10) Patent No.: US 6,467,634 B1
(45) Date of Patent: Oct. 22, 2002

(54) CASKET DISPLAY SYSTEM

(75) Inventor: Frank Pinco, Staten Island, NY (US)

(73) Assignee: South Brooklyn Casket Co., Inc., Brooklyn, NY (US)

( * ) Notice: Subject to any disclaimer, the term of this patent is extended or adjusted under 35 U.S.C. 154(b) by 0 days.

(21) Appl. No.: 09/689,156

(22) Filed: Oct. 12, 2000

(51) Int. Cl.[7] ..... A47G 29/00
(52) U.S. Cl. ..... 211/85.16
(58) Field of Search ..... 211/85.16, 13.1, 211/85.27, 119.002

(56) References Cited

U.S. PATENT DOCUMENTS

| | | | | |
|---|---|---|---|---|
| 1,156,755 A | | 10/1915 | Casey | |
| 1,841,412 A | | 1/1932 | Leicht | |
| 2,937,768 A | | 5/1960 | Davis | |
| 5,405,017 A | | 4/1995 | Szabo, Sr. et al. | |
| 5,524,394 A | | 6/1996 | Szabo, Sr. et al. | |
| 5,709,052 A | | 1/1998 | Szabo, Sr. et al. | |
| 5,797,499 A | | 8/1998 | Pinco | |
| 5,848,498 A | | 12/1998 | Szabo, Sr. et al. | |
| 5,901,862 A | * | 5/1999 | Riga et al. | 211/85.16 |
| 5,960,966 A | * | 10/1999 | Riga et al. | 211/85.16 |
| 6,070,741 A | * | 6/2000 | Bachman et al. | 211/85.16 |
| 6,105,793 A | * | 8/2000 | Riga | 211/85.16 |
| 6,145,671 A | * | 11/2000 | Riga et al. | 211/85.16 |
| 6,145,672 A | * | 11/2000 | Bachman et al. | 211/85.16 |
| 6,161,705 A | * | 12/2000 | Riga et al. | 211/85.16 |

* cited by examiner

*Primary Examiner*—Alvin Chin-Shue
*Assistant Examiner*—Sarah Purol
(74) *Attorney, Agent, or Firm*—Schweitzer Cornman Gross & Bondell LLP

(57) ABSTRACT

A casket display system has a ⅛ corner casket portion and a feature diplay disposed with an enclosure. The casket corner portion includes a full set of hardware a the feature display stand includes a name and photograph and with the description of the casket configuration, physical samples of the linings of the casket and a price.

6 Claims, 6 Drawing Sheets

CASKET DISPLAY SYSTEM

FIELD OF THE INVENTION

The invention pertains to the field of casket display systems, and in particular to casket display systems providing displays of various casket configuration and the optional features thereof.

BACKGROUND AND SUMMARY OF THE INVENTION

Caskets are available in a number of styles and designs, which can have various shapes, hardware (i.e., handles), colors, materials and quality. Often there are a number of options which can be chosen for any particular casket to create a customized casket configuration. These options include the material and pattern for the lining of the lid, and the lining of the interior of the casket.

Prior casket displays include an entire casket, arranged with the lid open to display the interior lining. This allows the consumer to view all of the features of the casket configuration. However, since caskets are necessarily large items, this type of display results in an inefficient use of space. A more space-efficient prior casket display includes a 1/16th corner portion of a casket. However, this fractional portion of the casket does not include a full set of the hardware of the casket.

The present invention provides an improved casket display system which provides immediate visual and tactile access to all of the influential features of particular casket configurations, in a space efficient manner.

Specifically, the casket display system of the present invention includes a five-sided enclosure having a base or bottom portion, a back portion, two lateral side walls and a top. An about 1/8th corner casket portion is disposed on the base, within the enclosure. The corner casket portion includes at least one full set of the hardware of the casket, which set is visible on an outwardly-facing side of the corner casket portion. The corner casket portion is preferably displayed in the closed position and occupies about ? of the width of the enclosure.

A feature display stand is disposed on the base within the enclosure and includes feature information items regarding the casket and a particular casket configuration. Preferably, the display stand includes a name and price of the casket configuration, a photograph of the entire casket, preferably shown with the lid open, physical material samples of the liner for the lid and for the interior of the casket, and a technical description of the casket. The feature display stand is disposed adjacent the corner casket portion and substantially occupies the remaining width of the enclosure.

The casket display system of the present invention provides an improved means to display various and multiple casket configurations in an easily viewable and space-efficient manner.

BRIEF DESCRIPTION OF THE DRAWINGS

For a complete understanding of the above and her features of the invention, reference shall be made to the following detailed description of the preferred embodiments of the invention and to the accompanying drawings, wherein.

DETAILED DESCRIPTION OF THE INVENTION

Figure 1:
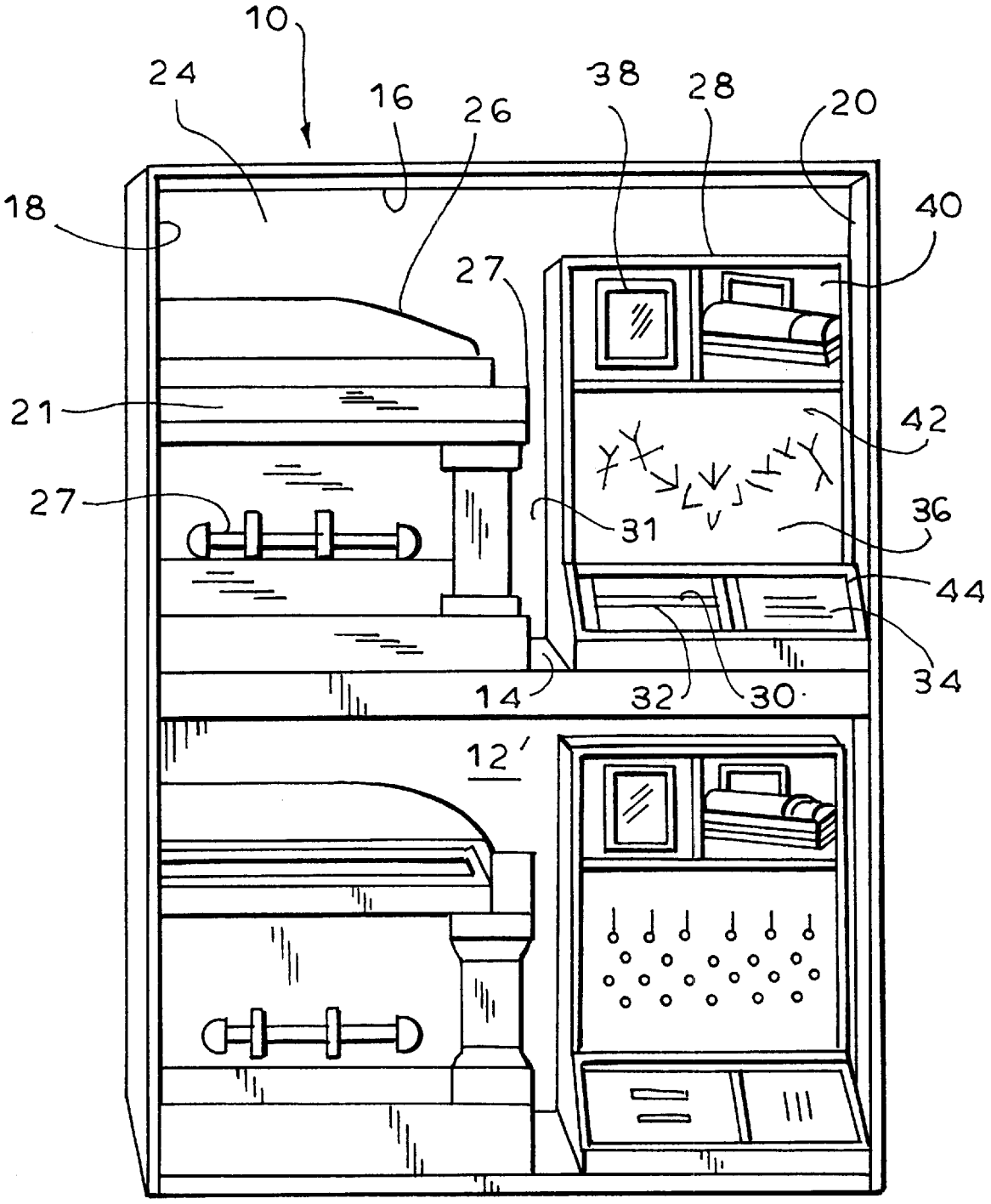
FIG. 1 is a front elevational view of the casket display system of the present invention.
Figure 2:
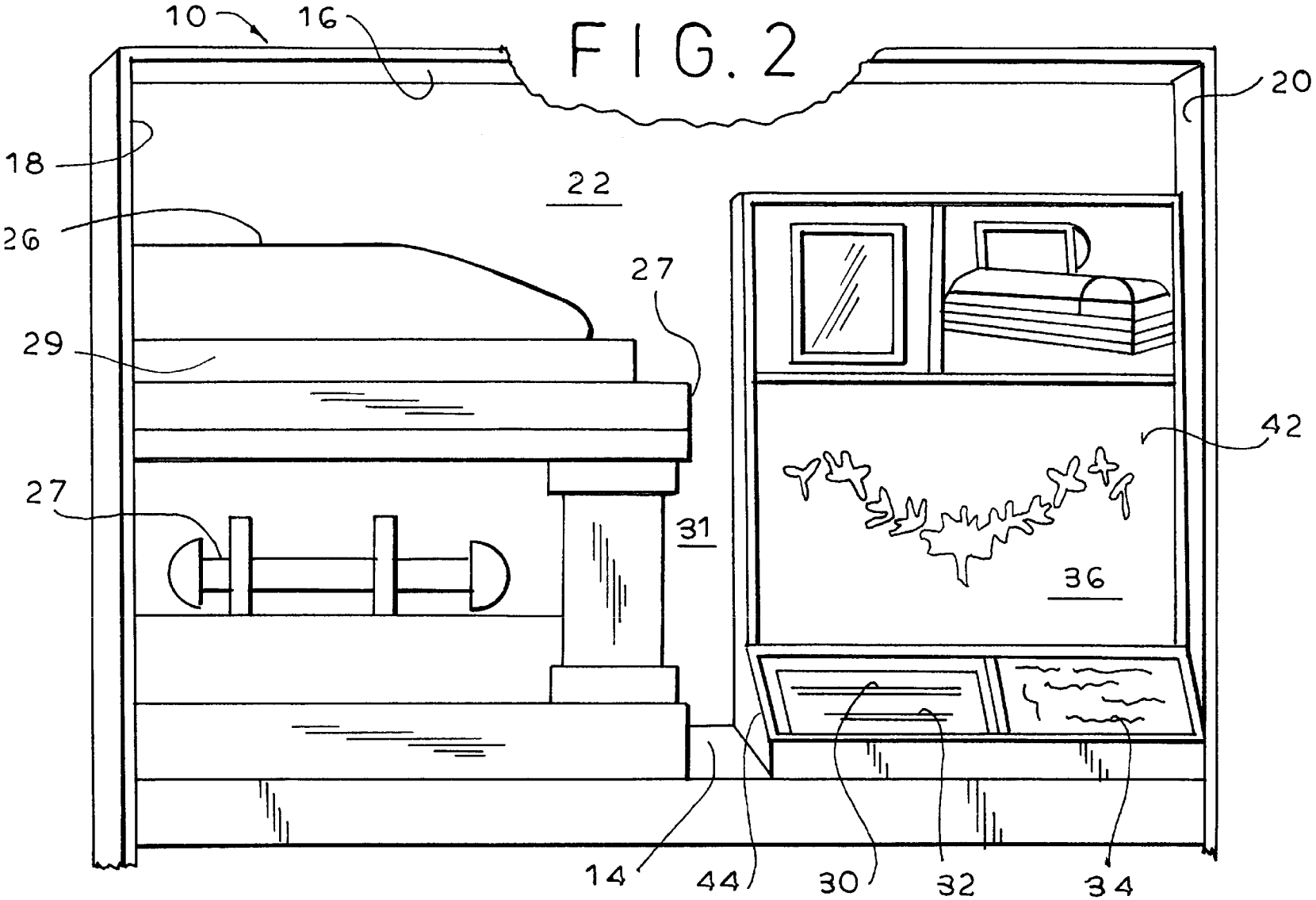
FIG. 2 is a close-up front elevational view of the invention as shown in FIG. 1, showing one enclosure of the system.
Figure 3:
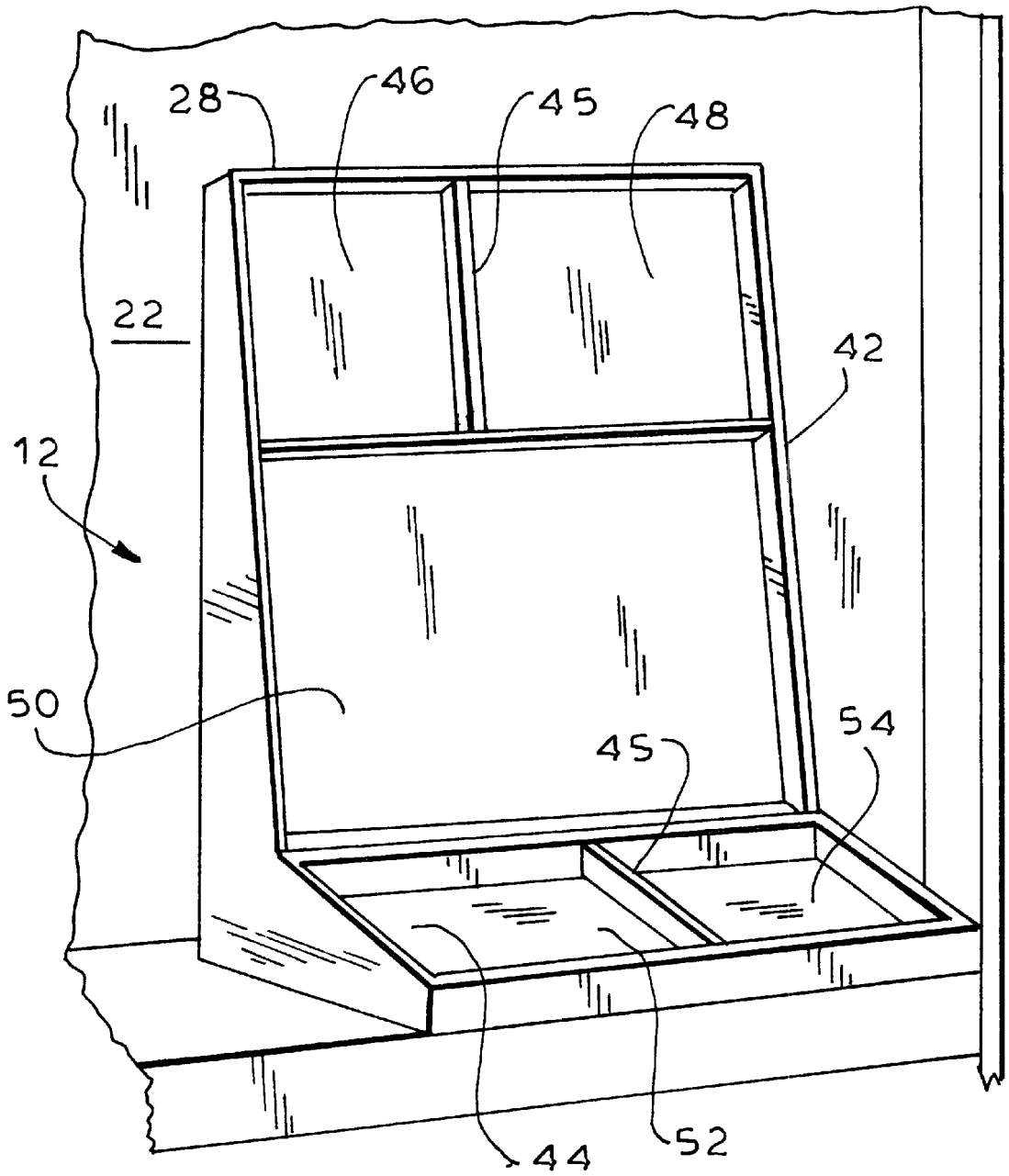
FIG. 3 is a perspective view of the feature display stand of FIG. 1.
Figure 4:
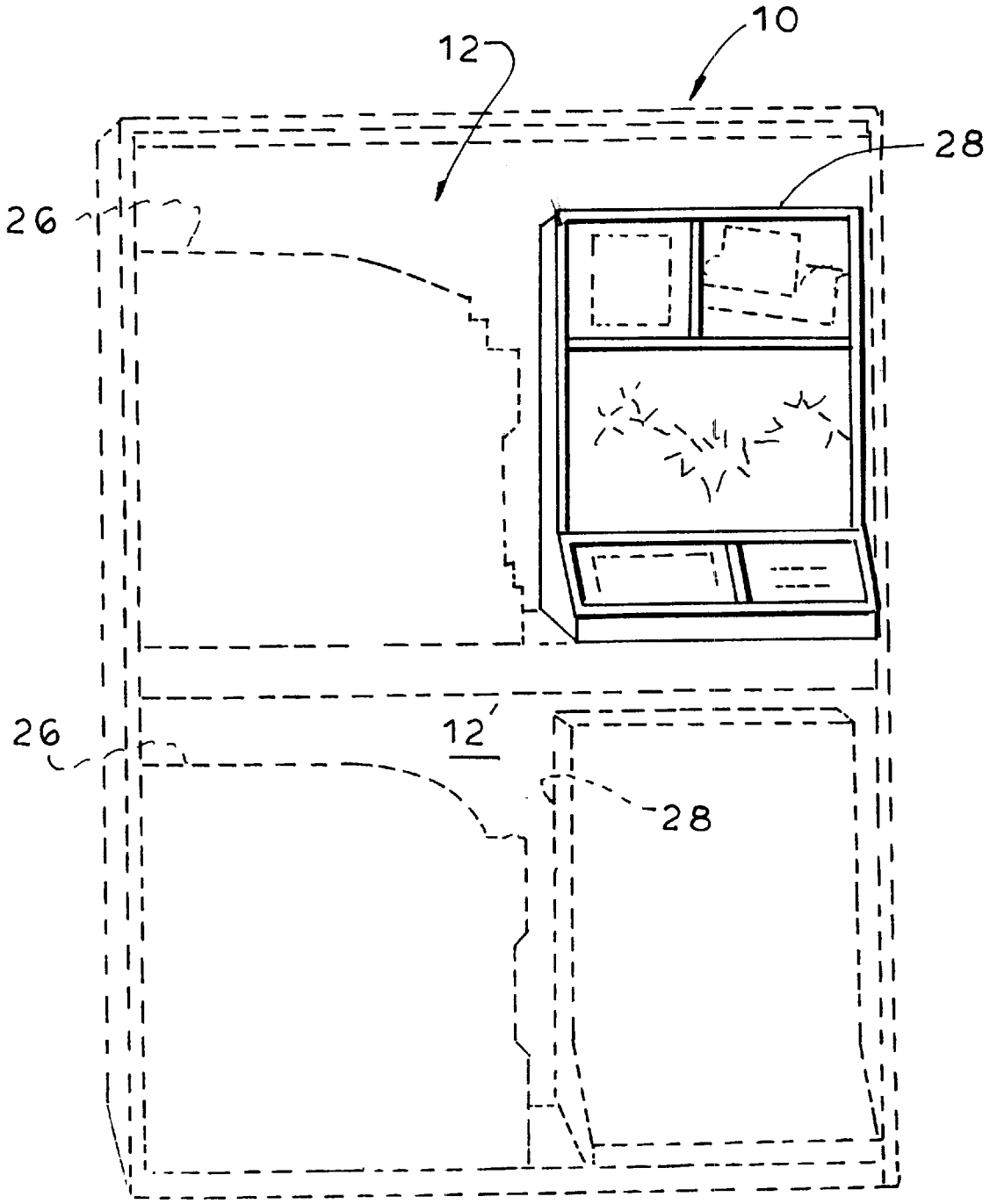
FIG. 4 is a front elevational view of the feature display stand shown in an environment.

Referring to FIGS. 1–3, the casket display system 10 of the present invention is intended for use in show rooms of funeral homes, and casket manufacturers, and any other suitable locations where caskets and casket configurations are displayed. The casket display system 10 may be most efficiently placed against, or built into a display room wall, or may be constructed as a stand-alone display. As shown, multiple enclosures 12, 12' can be stacked in a vertical column to provide greater display density, space efficiency and ease of viewing.

The casket display system 10 includes an enclosure 12 having five sides (bottom or base 14, top 16, two lateral sides 18, 20 and a back 22), and an open front portion 24. Preferably, the five sides of the enclosure are substantially planar and meet at right angles to form a substantially rectangular volume. The bottom 14 is preferably substantially horizontal, and the top 16, lateral sides 18, 20 and back 22 are preferably substantially vertical.

An about 1/8th corner portion of at least an exterior of a casket 26 is disposed on the bottom 14 of the enclosure 12. The 1/8th corner casket portion is preferably formed by casting or cutting a casket (or at least an exterior thereof) down a substantially straight longitudinal center line (i.e., lengthwise), and down a substantially straight line 1/4th of its length from one end, thereby creating a substantially right-angled corner casket portion 26. The corner casket portion 26 is preferably disposed in a corner (e.g., the lower, rear, left corner) of the enclosure 12 such that the cross-sectional (i.e., cut) edges of the corner casket portion 26 contact the (left) lateral side wall 18 and the back wall 22 of the enclosure along substantially the entire length of the edges, thereby forming a highly finished appearance. If desired, the corner casket portion 26 can be secured to the one or more sides of the enclosure by any suitable means. In addition, preferably the bottom 14 of the enclosure extends outwardly a distance from a front edge of the corner casket portion 26, when properly located.

Caskets typically have handle hardware disposed along the sides thereof and on each end. The hardware is an ornamental feature of the casket design (as well as being functional), which impacts on the overall appearance and attractiveness of the design. Therefore, it is important that a complete physical sample of the hardware be available for viewing. The corner casket portion 26 of the present invention includes one full set of the handle hardware 27 on an outwardly-facing side 29 thereof, which full set is visible by a viewer located in a viewing position in front of the display. Thus, the 1/8th corner casket portion provides the viewer with a view of all of the important aesthetic aspects of the casket, including the overall design, color and hardware design.

Preferably, the enclosure is sized and shaped such that the 1/8th corner casket portion 26 occupies approximately 1/2th the width of the enclosure 12 (i.e., 1/2th the distance between the lateral sides 18, 20). As caskets are typically manufactured in predetermined lengths, the enclosures of the present invention can be provided in a plurality of predetermined sizes or widths.

The casket corner portion 26 preferably has a maximum height of about 24 inches, a length of about 24 inches and a width of about 14 inches. Each enclosure 12, 12' is preferably about 30 inches high, about 48 inches wide and about 30 inches deep. The display system 10 as depicted in FIG. 10 preferably is about 90 inches high and 60 inches wide.

A feature display stand 28 is disposed on the bottom 14 of the enclosure 12, adjacent the corner casket portion 26. Preferably, the feature display stand 28 is located in the corner of the enclosure across from the casket corner portion 26, such that it abuts the back 22 and the (right) lateral side wall 20 of the enclosure 12 opposite the casket corner portion 26. Preferable, the feature display stand 28 occupies a majority of the opposite half of the width of the enclosure 12, with respect to the casket corner portion 26. However, preferably the enclosure 12 and feature display stand 28 are sized such that there exists a gap 31 between an end portion 27 of the casket corner portion 26 and an adjacent edge 31 of the feature display stand, such that the end portion 27 of the casket corner portion 26 is available for viewing and inspection by the consumer. Preferably, the gap can be about 2 to about 6 inches.

Figure 5:
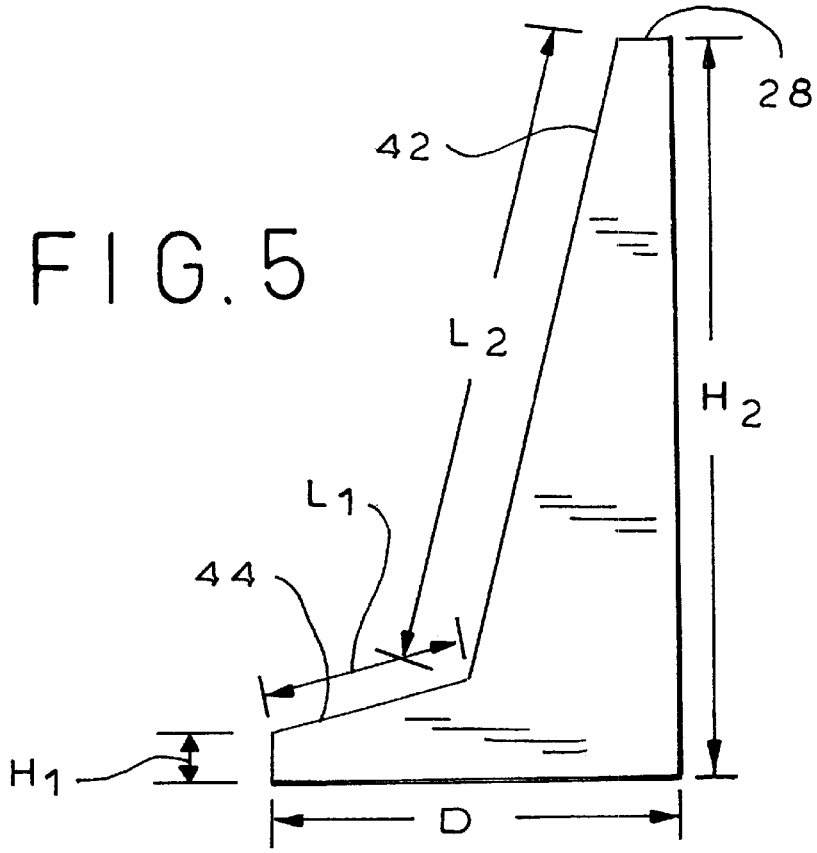
FIGS. 5–8 are side bottom, rear and top views of the feature display stand.
Figure 6:
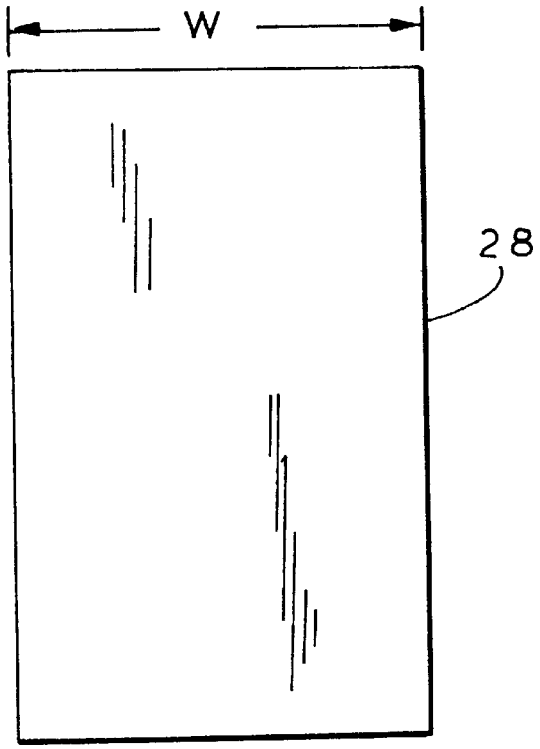
Figure 7:
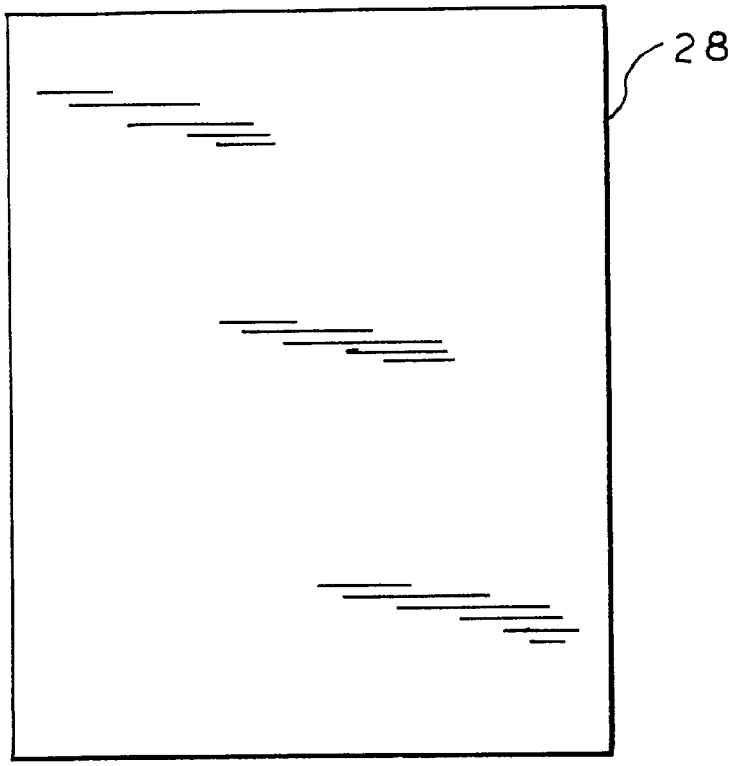
Figure 8:
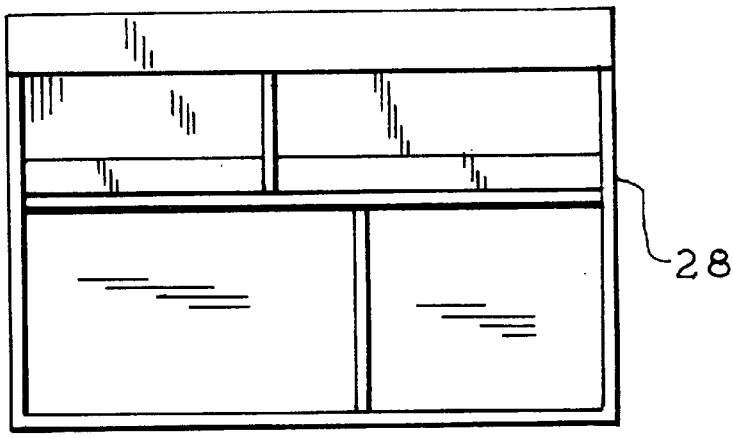

Referring to FIGS. 5 and 6, the feature display stand preferably has a front height ($H_1$) of about 2 inches rear height ($H_2$) of about 25 inches, a depth (D) of about 14 inches and a width (W) of about 19 ½ inches. The lower panel 42 has a length ($L_1$) of about 7 inches and the upper panel 44 has a length ($L_2$) of about 22 inches.

The feature display stand 28 includes all of the various important aesthetic and function features items of the casket configuration, including a name 30 and price 32 of the configuration, a physical material sample of the interior lining for the casket configuration 34, a physical material sample of the lining of the lid of the casket configuration 36, a technical description of the casket 38, and a photograph of the entire casket 40, as configured, preferably with the lid in an open position. The material used in casket configurations, most often the lid lining, can include repeating patterns, such as embroidered patterns. Therefore, the samples 34, 36 are preferably large enough to include an entire ?repeat? of the pattern.

The feature display stand 28 preferably includes upper and lower substantially planar panels 42, 44 each of which include a number of sections defined by raised rib or border portions 45. The upper panel 42 preferably includes first and second upper sections 46, 48, and a lower section 50. The lower section 46 preferably occupies the majority of the upper panel 42.

The upper sections 46, 48 of the upper panel 42 of the feature display stand 28 preferably include one of the technical description of the casket 38, and photograph of the entire casket 40. The lower section 50 of the upper panel 42 preferably includes a relatively large physical material sample of the lining of the lid of the casket configuration 36, which is exposed and available to be touched by prospective buyers. The lower panel 44 preferably includes two sections 52, 54, also defined by raised rib or border potions 45. The two sections 52, 54 of the lower panel 44 preferably include one of (1) the name 30 and price 32 of the casket configuration and (2) the physical material sample of the lining of the interior of the casket configuration 34.

The physical material samples 34, 36 preferably comprise a section of material and padding mounted on a frame which frame is sized and shaped to be closely received within a section of the feature display. Therefore, the associated sections at the feature display are preferably recessed to receive the frame-mounted samples.

The upper and lower panels 42, 44 of the feature display stand 28 preferably meet to form an obtuse angle (i.e., an angle greater than 90 degrees). The upper and lower panels 42, 44 are preferably aligned at upwardly-inclined angles from the open front portion 24 of the enclosure 12 toward the back 22. Specifically, a plane of the upper panel 42 forms an acute angle with the back 22 of the enclosure, preferably between about 10 and about 50 degrees, and a plane of the lower panel 44 forms an acute angle with the bottom 14 of the enclosure, preferably between about 10 and about 30 degrees.

At the described orientation, the upper panel 42 provides ready and optimal viewing, from a distance, of the photograph of the entire casket 40 and the relatively large material sample of the lining of the lid 36, which are aesthetic features which often are part of the initial buying decisions of a consumer. As initial buying decisions are often made while a consumer is browsing through a display room, usually at a distance from the individual displays, it is most effective to have these types of feature items prominently displayed and readily visible from a distance. The orientation of the lower panel 44 provides more optimal viewing of the name 30 and price 32 of the casket configuration from a position in relative proximity to the display. Then name and price of a configuration are often information which a consumer wishes to have once the consumer is more interested in the configuration. Therefore, these feature items are placed such that they are most easily viewed when in relative proximity to the display.

The exposed material samples 34, 36 allow and invite the consumer to view and touch the material to determine the quality and makeup of the material, which are often important considerations. The feature display stand 28 allows such visual and tactile inspection of the material samples 34, 36 without manipulation of the display by the consumer or the sales representative.

The novel casket display system 10 of the present invention provides an improved means to display various casket configurations, which displays all of the important aesthetic and functional aspects of each configuration in an optimal manner such that the prospective consumer can readily view and touch the feature items of the configuration without manipulation of the display by the consumer or sales representative.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A casket display system for displaying a casket configuration having a casket and selected optional components, said casket display system comprising:

an enclosure;

a corner portion of said casket of said casket configuration, said corner portion of said casket being disposed within said enclosure, said corner portion of said casket including substantially all of a hardware set on an outwardly-facing side thereof; and a feature display disposed adjacent said corner portion of said casket, within said enclosure, said feature display including feature items including:

a name of said casket configuration;

a photograph of an entirety of said casket;

a written description of technical specifications of said casket;

a physical sample of a casket lid lining of said casket configuration;

a physical sample of a casket interior lining of said casket configuration; and a price of said casket configuration;

said corner portion of said casket and said physical sample feature items being exposed and being touchable by a consumer viewing position in front of said enclosure, without manipulation of the display;

whereby said casket display system provides immediate visual and tactile access to important features of the casket configuration, in a space-efficient manner.

2. A casket display system, as in claim 1, wherein:

said feature display comprises an integral display stand having first and second panels;

said first and second panels each being divided into a plurality of sections; and each section of said first and second panel including one of said feature items.

3. A casket display system as in claim 2, wherein:

said enclosure having a substantially horizontal base upon which said casket corner portion and said display stand are disposed, and a substantially vertical back portion with which said casket corner portion and said display stand are in contact;

said first and second panels of said display stand each being aligned at an upwardly-inclined angle from an open front of said enclosure toward said back portion;

a plane of said first panel forming an acute angle with said back portion of said enclosure between about 10 degrees and about 50 degrees, such that feature items displayed on said first panel are readily visible outside said consumer viewing position;

a plane of said second panel forming an acute angle with said base of said enclosure between about 10 degrees and about 30 degrees such that feature items displayed on said second panel are best visible from said consumer viewing position; and said, photograph and said physical sample of a casket lid lining of said casket configuration being located on said first panel, said physical sample comprising a majority of an area of said first panel; and said name and price of said casket configuration being located on said second panel.

4. A casket display system as in claim 1, wherein said feature display stand includes upper and lower forwardly-facing panels, said upper and lower panels being substantially planar and meeting at a substantially obtuse angle, and being upwardly and rearwardly inclined.

5. A casket display system as in claim 4, wherein:

said upper panel of said feature display stand includes a photograph of said casket configuration and a physical sample of a lid lining material of said casket configuration; and said lower panel of said feature display stand includes (a) a name or cost of said casket configuration and (b) a physical sample of a casket interior lining material of said casket configuration.

6. A casket display system as in claim 4, wherein said physical material samples are mounted on frames which are received within recesses in said feature display stand.

* * * * *

UNITED STATES PATENT AND TRADEMARK OFFICE

CERTIFICATE OF CORRECTION

PATENT NO. : 6,467,634 B1
DATED : October 22, 2002
INVENTOR(S) : Frank Pinco

It is certified that error appears in the above-identified patent and that said Letters Patent is hereby corrected as shown below:

Column 1,
Line 41, change "?" to -- half --

Column 3,
Line 42, change "?repeat?" to -- repeat --

Column 5,
Line 12, after "consumer", insert -- in a --

Signed and Sealed this

Fourth Day of February, 2003

JAMES E. ROGAN
*Director of the United States Patent and Trademark Office*